US005311436A

United States Patent [19]

Trennel

[11] Patent Number: 5,311,436

[45] Date of Patent: May 10, 1994

[54] AUTOMATIC RAPID ATTACHABLE WARHEAD SECTION

[75] Inventor: Anthony J. Trennel, Albuquerque, N. Mex.

[73] Assignee: The United States of America as represented by the United States Department of Energy, Washington, D.C.

[21] Appl. No.: 652,736

[22] Filed: Feb. 8, 1991

[51] Int. Cl.[5] ..... G06F 15/46; G06F 15/20; G06F 15/14

[52] U.S. Cl. ..... 364/468; 364/423; 364/478

[58] Field of Search ..... 364/468, 423, 478

[56] References Cited

U.S. PATENT DOCUMENTS

| | | | |
|---|---|---|---|
| 2,981,187 | 4/1961 | Riordan et al. | 102/49 |
| 3,277,826 | 10/1966 | Silverthorne | 102/92.5 |
| 3,670,621 | 6/1972 | Nash | 89/1.8 |
| 4,516,499 | 5/1985 | Eyman | 102/293 |
| 4,530,269 | 7/1985 | Rau et al. | 89/1.14 |
| 5,036,465 | 7/1991 | Ackerman, Jr. et al. | 364/423 |
| 5,036,466 | 7/1991 | Fitzgerald et al. | 364/423 |

OTHER PUBLICATIONS

John C. Weydert, *A Discussion of Rocket Vehicle Joint Characteristics*, Sandia Laboratory, Albuquerque, NM, May 1, 1968.

*Primary Examiner*—Jerry Smith
*Assistant Examiner*—Jim Trammell
*Attorney, Agent, or Firm*—Russell D. Elliott; James H. Chafin; William R. Moser

[57] ABSTRACT

Disclosed are a method and apparatus for (1) automatically selecting warheads or reentry vehicles from a storage area containing a plurality of types of warheads or reentry vehicles, (2) automatically selecting weapon carriers from a storage area containing at least one type of weapon carrier, (3) manipulating and aligning the selected warheads or reentry vehicles and weapon carriers, and (4) automatically coupling the warheads or reentry vehicles with the weapon carriers such that coupling of improperly selected warheads or reentry vehicles with weapon carriers is inhibited. Such inhibition enhances safety of operations and is achieved by a number of means including computer control of the process of selection and coupling and use of connectorless interfaces capable of assuring that improperly selected items will be rejected or rendered inoperable prior to coupling. Also disclosed are a method and apparatus wherein the stated principles pertaining to selection, coupling and inhibition are extended to apply to any item-to-be-carried and any carrying assembly.

26 Claims, 8 Drawing Sheets

AUTOMATIC RAPID ATTACHABLE WARHEAD SECTION

The United States Government has rights in this invention pursuant to Contract No. DE-AC04-76DPOO789 between the United States Department of Energy and AT&T Technologies, Inc.

BACKGROUND OF THE INVENTION

The present invention relates to the field of rockets and reentry vehicles, and more particularly to apparatus and methods of assembling and disassembling warheads and/or reentry vehicles from missiles or rockets.

Furthermore, the invention provides connectorless means to transmit and receive power, data, or both across an interface formed by an assembled missile and warhead or reentry vehicle.

In the field of assembling or separating one component from another component in a rocket or missile assembly, several techniques are known. The following U.S. Pat. Nos. are known and are discussed hereinbelow: 2,981,187 of Riordan et al.; 3,277,826 of Silverthorne; 3,670,621 of Nash; 4,516,499 of Eyman; and 4,530,269 of Rau et al.

Riordan et al. disclose a pneumatic mechanism for a booster clamp ring release. This device is designed to attach a booster to a missile section and at some point in flight during booster pressure decay, it activates to release a ring such that the booster falls away without imparting damaging loads on the missile section. The device is installed manually and an index bolt requires a critical adjustment prior to assembly of booster to the missile. The purpose of the Riordan et al. device is effected by a pneumatic valve assembly that releases the attachment ring upon a certain booster pressure reduction. Thus, the signal to accomplish an action is a physical state change. No information is provided to activate the intended function, and the signal to release is a part of the booster itself. Data and signalling are not transmitted across an interface between major missile sections. There is no data transmitted between the booster and the missile body interface. The means to decouple the booster from the missile body can only be accomplished once, and it can only be done under certain conditions of flight. Repetitive assembly and disassembly is neither provided for nor required. In any event, activation of the valve is irreversible, and refurbishment of the replacement of the valve would be necessary after system functioning.

Silverthorne discloses a warhead cone latching device that is shown as attaching to a warhead. The device is designed to raise or lower the cone. However, the cone itself must be manually attached by the use of a set screw holding the cone ring to the bar that moves the cone up or down. Thus, the device appears to be incapable of going from a completely unattached state to an attached state automatically. At least two actions must be accomplished by assembly personnel: the aforementioned set screw must have been set to fix the cone to the bar; and in moving the cone upwards or downwards, a detent must be depressed to move the pawl away from the bar so that movement can occur. At column 1, lines 31–36 there is a disclosure that the nose cone can be secured by using standard hand tools with the operator wearing heavy, cumbersome arctic mittens. This refers to the manual set screw attachment. At column 1, lines 41–44 there is a statement that it is possible to remove and or attach the cone without the use of any tools. Thus, two manual steps are required, but only one after the cone is secured. This kind of cone latching device may be adequate to constrain the cone to a warhead body during flight. However, it is not likely that it would be able to function as a means to support a nominal warhead or a reentry vehicle having a warhead installed. The reason for this is that dynamic flight and inertial loads will be applied to the slide bar 17 and to the hooked-shaped pawl 19 that retains the bar. These items, mounted asymmetrically would not appear to have either the strength, nor the stiffness necessary. No provision is made to mechanically join the warhead cone to the warhead about the area of the pedestal 11. Thus, the actual latching engagement area is only the area of the pawl tip.

Nash discloses a rocket launcher fairing (a cover) with structural components for connecting the fairing to the rocket launcher. The rocket launcher fairing is for launchers that are suspended under aircraft or helicopters. The polystyrene material of this frangible fairing and the means to bond it to the launcher are clearly not suitable to consider as a means to attach a warhead or reentry vehicle to a guided missile or rocket. Even a rocket or missile that is launched from an aircraft must fly under dynamic loads that can be quite severe and a fairing of this type would not likely endure this dynamic environment. The plastic bonding agent would be totally inadequate to even sustain the static weight of a typical warhead/reentry vehicle let alone the dynamic conditions described above. The fairing disclosed in the Nash patent appears to function as both a cover for a rocket launching system, and it is disassembled by the flight of rockets through it. The fairing is frangible specifically for this purpose.

Eyman discloses a quick access splice joint that connects one missile section to another missile section. A plurality of splice joints are necessary for disassembling the connection. Upon assembly, the shear type pins are triggered or released to fit into mating parts on the missile section to be attached. Once the missile sections are attached to each other, the shear pins provide strength, stiffness, and integrity to the joint. Furthermore, to disassemble the spliced joint, manual use of a tool (an allen wrench) is needed. The manual tool is needed to exert both an inward force and a torque on each shear pin to dislodge them and return then to the appropriate position allowing for disassembly. There are likely several factors that influence both torque and force. For instance, the length of time that the joint was assembled, the environmental conditions the joint was subjected to, and so forth. Furthermore, automation of this process where three or more devices would be required to perform the same function that the manual design calls for, would require extensive synchronization so that all pins were retracted prior to any further movement. This very complex kind of joint was certainly not designed to be automated, and the inventor makes note of the variabilities that can be encountered for the prescribed manual disassembly, where such variabilities make automation even more impractical. There are no means discussed for either transmission of power or data across the interface that this joint provides.

Rau et al disclose a remotely initiated separation latch assembly. The purpose of this device is to latch one body to another and to provide for subsequent rapid disassembly through the use of a remote signal. The means to provide for the initial latching or assembly are not clearly defined. The patent mentions the use of a bonding adhesive, which is clearly not suitable for a joining process that can be separated at some future time. The main purpose of this device is carrying out the separation process with the use of explosives. In summary, the attachment process is manual and means can be varied in not clearly defined ways. The separation process is carried out by explosives and cannot be regarded as a device that provides for reassembly after an initial disassembly.

In view of some of the inadequacies and deficiencies in the prior art discussed above, it would be desirable if information were provided from a source remote from the missile components to activate the intended assembly or disassembly functions of major missile components. It would be desirable if data and signalling were transmitted across an interface between major missile sections while on the ground and while in flight. It would also be desirable if repetitive assembly and disassembly of major missile components were carried out automatically, instead of manually requiring specially trained personnel and special tools. It would be desirable to provide an apparatus for automatic assembly and disassembly of major missile components that provides a strong connection that withstands static and dynamic forces encountered on the ground and in flight.

Generally, assembling a warhead or reentry vehicle to a missile or other weapon carrier is a time consuming process requiring skilled personnel and specialized tools. Generally, screws or bolts are installed about the warhead or reentry vehicle perimeter that mate to a drilled and tapped mounting ring. Once this is done (sometimes beforehand) electrical and any remaining mechanical interfaces are completed by the personnel. These personnel-performed processes can be considered a disadvantage in that they are quite cumbersome and time consuming. Furthermore, the work pattern of personnel carrying out these tasks, under certain circumstances, provide signatures that an adversary could detect.

Furthermore, for political or military operational purposes, it may be desirable to maintain separation of warheads and reentry vehicles from their respective missiles, and yet be able to attain full readiness quickly. In this respect, it would be desirable to have an automated system that provides for automatic assembly and disassembly of warheads and reentry vehicles to their respective missiles.

SUMMARY OF THE INVENTION

Accordingly, an object of the present invention is to provide apparatus for remote control of assembly and disassembly of major missile components.

Another object is to provide apparatus for assembly and disassembly of major missile components in which data and control signals are transmitted across an interface between major missile sections while on the ground and while in flight that includes both assembly alignment and subsequent missile and warhead data and power interactive functions.

Still another object of the invention is to provide apparatus for assembly and disassembly of major missile components in which repetitive assembly and disassembly of major missile components are carried out automatically, instead of manually requiring specially trained personnel and special tools.

Yet another object of the invention is to provide automatic apparatus for assembly and disassembly of major missile components that provides a strong connection that withstands static and dynamic forces encountered on the ground and in flight.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus and method is provided for assembling selected warheads or reentry vehicles with selected weapon carriers. A plurality of warheads or reentry vehicles are retained in a first storage area. A plurality of weapon carriers are retained in a second storage area. A computer controlled means is provided for selecting a warhead or reentry vehicle from the first storage area. Additional computer-controlled means are provided for selecting a weapon carrier from the second storage area. The selected warhead or reentry vehicle is transported to the selected weapon carrier.

Automatic means are provided for coupling the selected warhead or reentry vehicle to the selected weapon carrier. Under computer control, a connectorless interface conveys alignment information between the selected warhead or reentry vehicle and the selected weapon carrier to assure proper alignment thereof. Once proper alignment is obtained, the selected warhead or reentry vehicle and the selected weapon carrier are automatically coupled by a V-band assembly which includes an expandable and contractible, drive-motor-controlled, V-band (or V-shaped belt). The V-band drive motor is also controlled by the computer. The connectorless interface additionally functions as the means to communicate signals and transfer power from the missile to the warhead or reentry vehicle, or from the warhead or reentry vehicle to the missile while on the ground or while in flight.

The apparatus of the present invention is used for both assembling the selected warhead or reentry vehicle with and disassembling the selected warhead or reentry vehicle from the selected weapon carrier. The weapon carrier can be a missile, a bomb, or other weapon carrier.

In accordance with another aspect of the present invention, an apparatus is provided for assembling an item to-be-carried with a carrying assembly. This apparatus includes means for conveying alignment information between the item to-be-carried and the carrying assembly, wherein the item to-be-carried and the carrying assembly are not connected to one another, the alignment information being in the form of signals conveyed between the item to-be-carried and the carrying assembly. Means are also provided that are responsive to the alignment information, and that orient the item to-be-carried with respect to the carrying assembly. Once it is determined that the item-to-be-carried and the carrying assembly are in proper alignment, that is once they are appropriately juxtaposed, they are automatically coupled to each other by automatic coupling means.

In accordance with yet another aspect of the present invention, a method is provided for assembling selected warheads or reentry vehicles with selected weapon carriers. The method is comprised of the steps of: remotely selecting a weapon carrier from a plurality of weapon carriers; remotely selecting a warhead or reentry vehicle from a plurality of warheads or reentry vehicles; automatically aligning the selected warhead or reentry vehicle with the selected weapon carrier; and automatically coupling the aligned selected warhead or reentry vehicle to the selected weapon carrier.

In accordance with another aspect of the invention, an apparatus is provided for joining a warhead or reentry vehicle to a weapon carrier. The apparatus includes a V-band coupling assembly which includes an expandable and contractible V-band, a retention cowl for retaining the V-band in an expanded state, and a motor coupled to the V-band for expanding and contracting the V-band. Engaging structures of the warhead or reentry vehicle are provided for engaging an adjacent weapon carrier. Engaging structures of the weapon carrier are provided for engaging an adjacent warhead or reentry vehicle. The engaging structures of the warhead or reentry vehicle and the weapon carrier are complementary to one another. The engaging structures of the warhead or reentry vehicle and the weapon carrier are not only complementary to one another, but they are also complementary with the V-band, such that when the warhead or reentry vehicle and the weapon carrier are in proper alignment, and when the V-band is contracted, the warhead or reentry vehicle, the weapon carrier, and the V-band form a mutually complementary joint for joining the warhead or reentry vehicle with the weapon carrier.

Still other objects of the present invention will become readily apparent to those skilled in this art from the following description, wherein there is shown and described a preferred embodiment of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION

Figure 1:
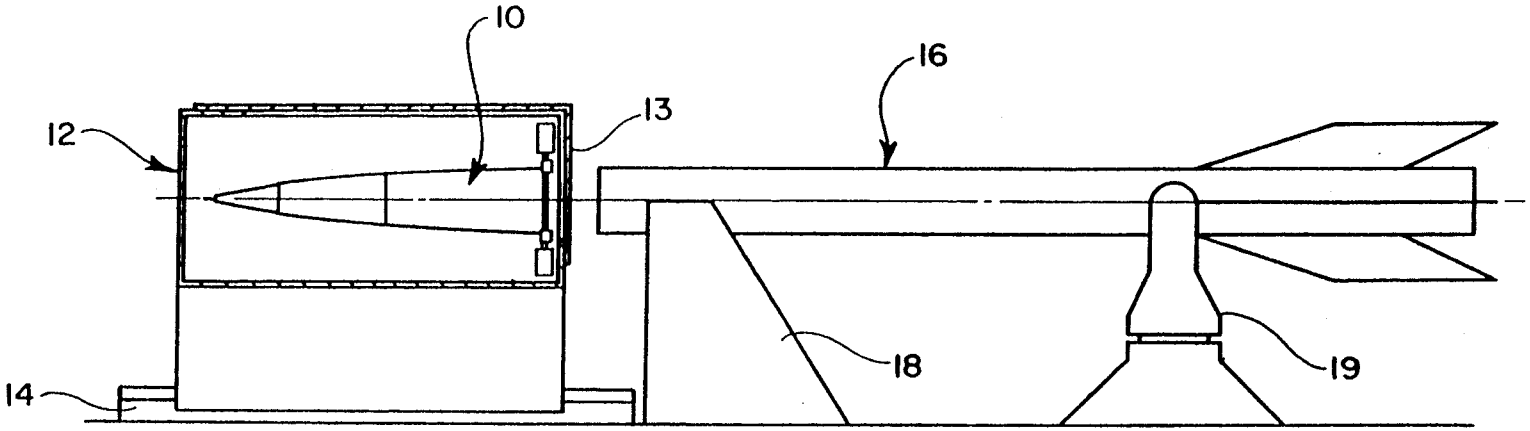
FIG. 1 is a schematic diagram of a warhead in a closed vault near a missile.

With reference to FIG. 1, a warhead 10 is located in a vault 12 which is mounted on a track 14. The vault 12 is one vault in a plurality of vaults in a warhead storage magazine, depicted by vault 12 in FIG. 1 and vault 20 in FIG. 2. Vault 12 is a sufficient distance away from a missile 16 so that the warhead 10 and the missile 16 are separated from one another. The missile 16 is one missile in a plurality of missiles in a missile storage magazine, depicted by missile 16 in FIG. 1 and missile 22 in FIG. 2. The vault 12 has a vertically oriented door 13 which is closed. The missile 16 is supported by a rigid support 18 and a tiltable support 19.

Figure 2:
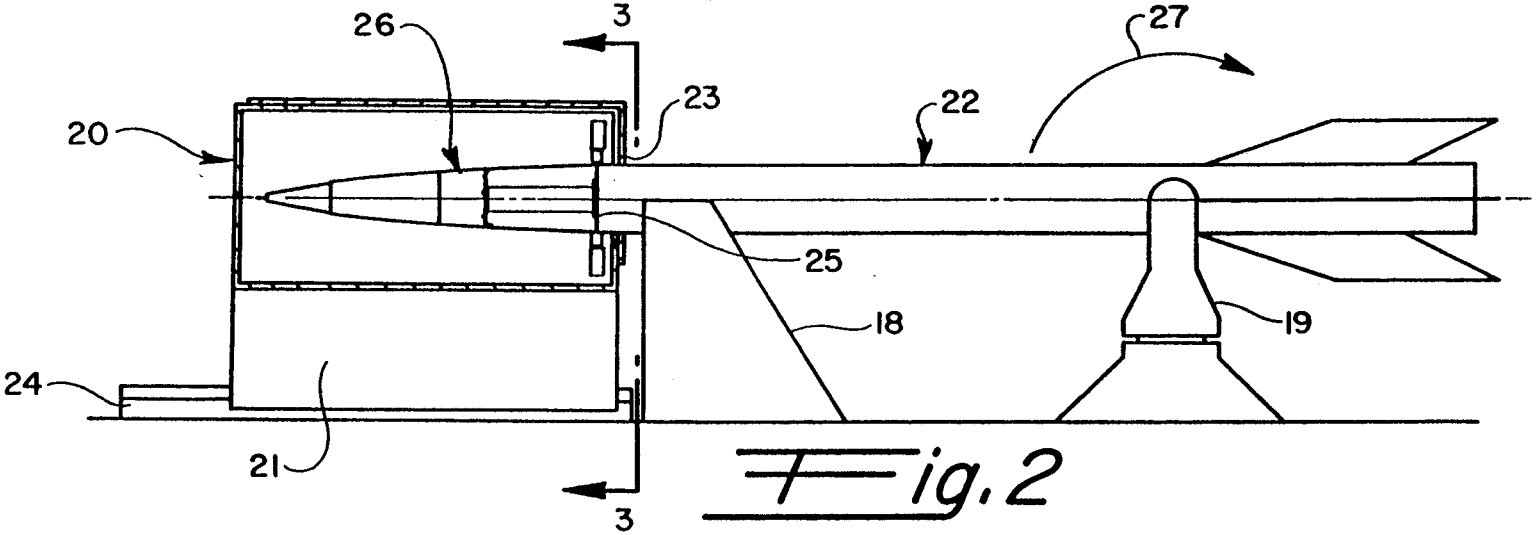
FIG. 2 shows a vault, warhead, and missile adjacent to the vault, warhead, and missile of FIG. 1 with the vault open and the warhead and missile juxtaposed.

In FIG. 2, the vault 20 has been moved along the track 24 toward the missile 22 by a powered carriage 21. The vertically oriented door 23 has been opened, thereby permitting the near end 25 of the missile 22 to enter into the vault 20 and be joined to the warhead 26. The operation of the vault 20, missile 22, vertically oriented door 23, and the joining of the warhead 26 to the missile 22 is controlled by a computer 29 (shown in schematically in FIG. 6 described below).

Figure 3:
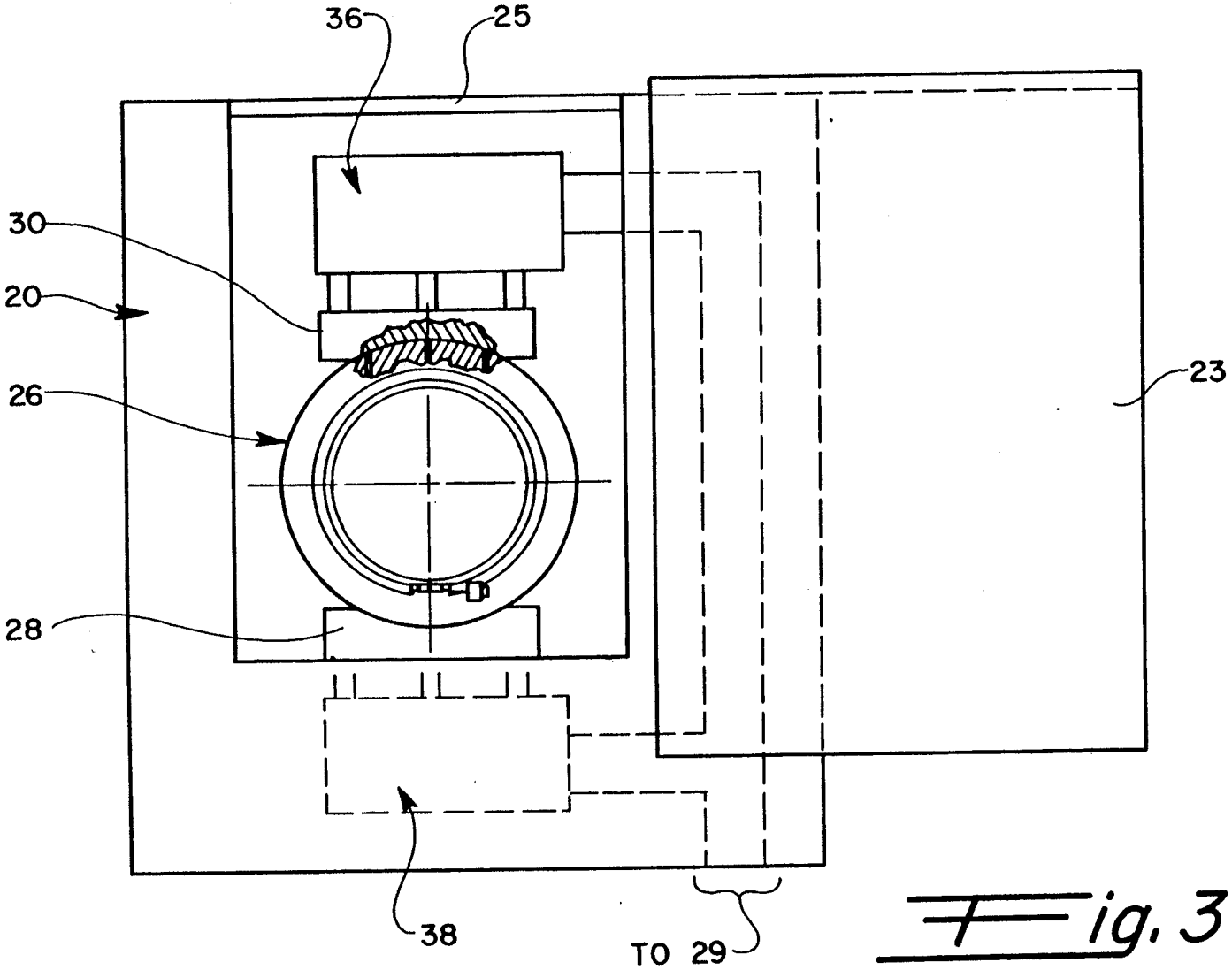
FIG. 3 is a cross-section taken along line 3—3 in FIG. 2.

In the cross-sectional view shown in FIG. 3, vertically oriented door 23 is shown to be open. A horizontally oriented top door 25 is shown to be closed. Inside the vault 20, the warhead 26 is supported and oriented by retractable bottom fixture 28 and by retractable top fixture 30. It is noted that once the warhead 26 and the missile 22 are joined, they can be fired as a unit. To do so, the horizontally oriented top door 25 would be opened, and the unified, joined warhead/missile unit would be tilted in the direction of arrow 27 (shown in FIG. 2) on tiltable support 19.

Figure 4:
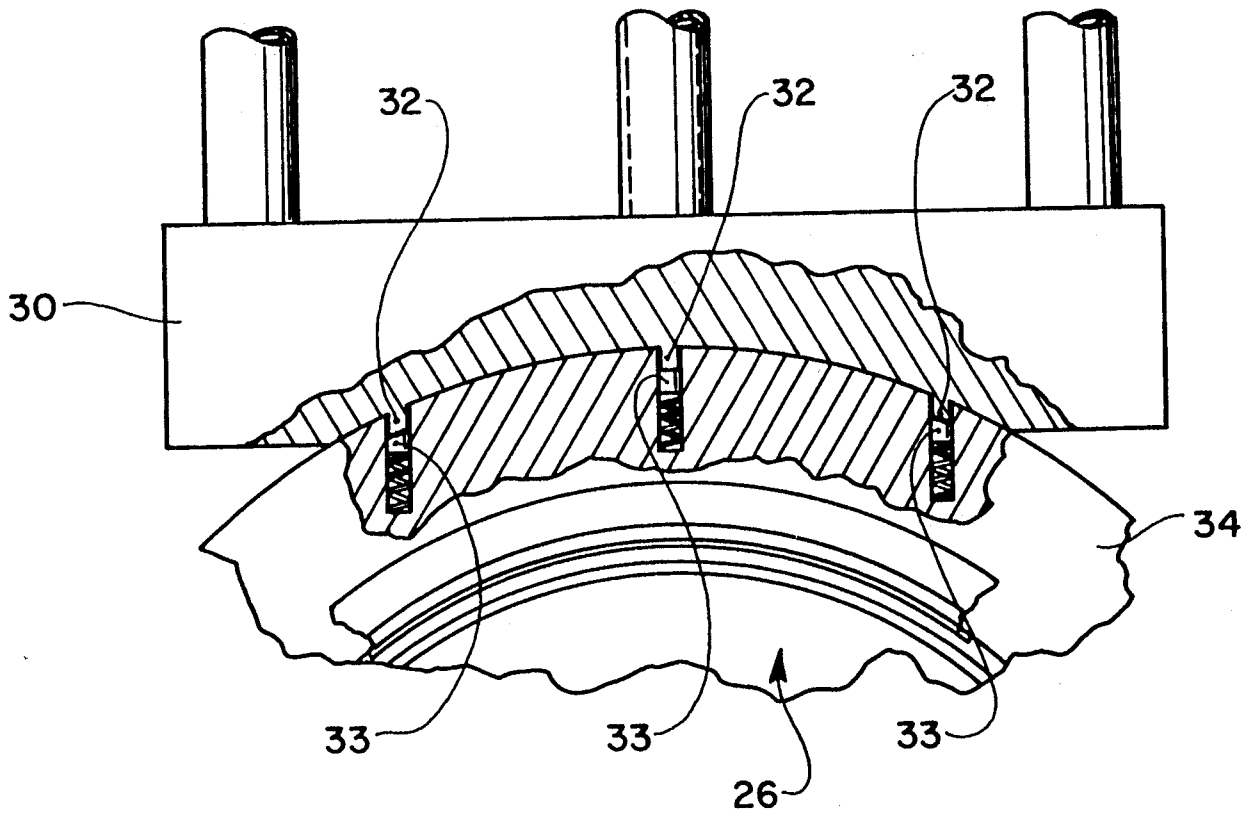
FIG. 4 is a partial enlargement of a portion of FIG. 3 showing means for holding the warhead in proper orientation.

In the partial enlargement of the portion of FIG. 3 shown in FIG. 4, the top fixture 30 includes three hold pins 32 which fit into complementary pin-receiving holes 33 in an integrated warhead support ring 34 which supports the warhead 26 in the proper orientation. After the warhead 26 and the missile 22 are joined, the retractable top fixture 30 is retracted by top ram 36 (see FIG. 3), and the retractable bottom fixture 28 is retracted by bottom ram 38 (see FIG. 3). Both top ram 36 and bottom ram 38 are controlled by the computer 29 shown in FIG. 6.

Figure 5:
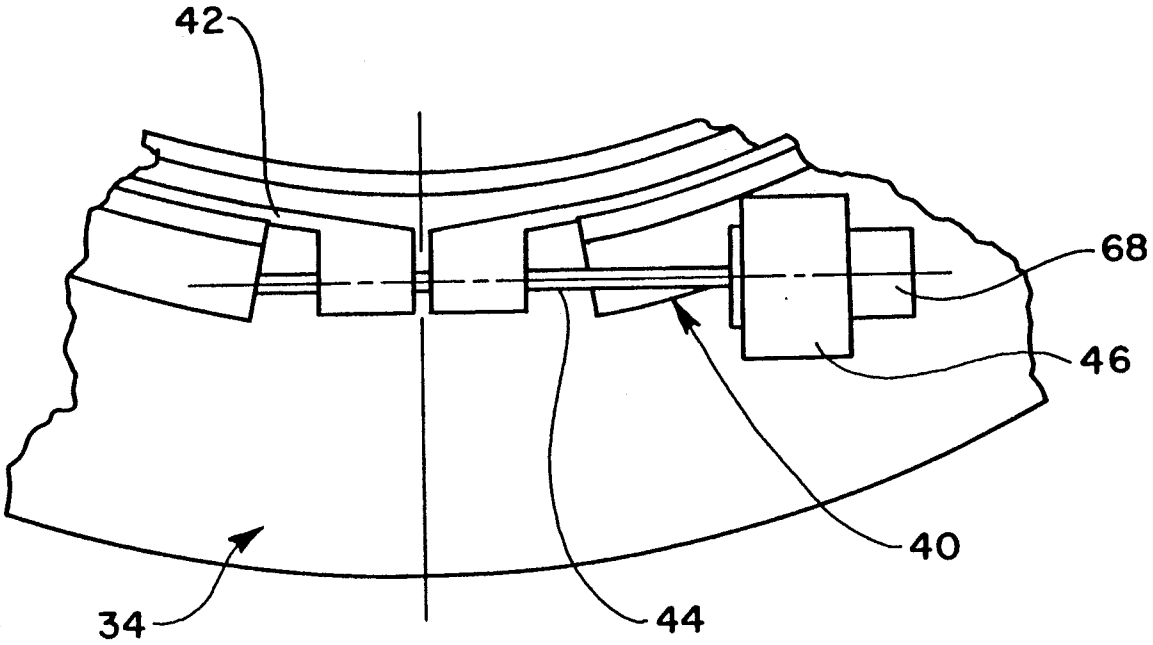
FIG. 5 is a partial enlargement of a portion of FIG. 3 showing a drive motor and drive shaft for powering the V-band for joining the warhead to the missile.

In the partial enlargement of the portion of FIG. 3 shown in FIG. 5, a portion of a V-band assembly 40 is shown attached to the warhead support ring. The V-band assembly 40 is comprised of a retractable and expandable V-band 42, a drive shaft 44 for expanding and contracting the V-band 42, and a motor 46 for driving the drive shaft 44. The motor 46 is connected to the computer 29 by control wires (not shown).

Figure 6:
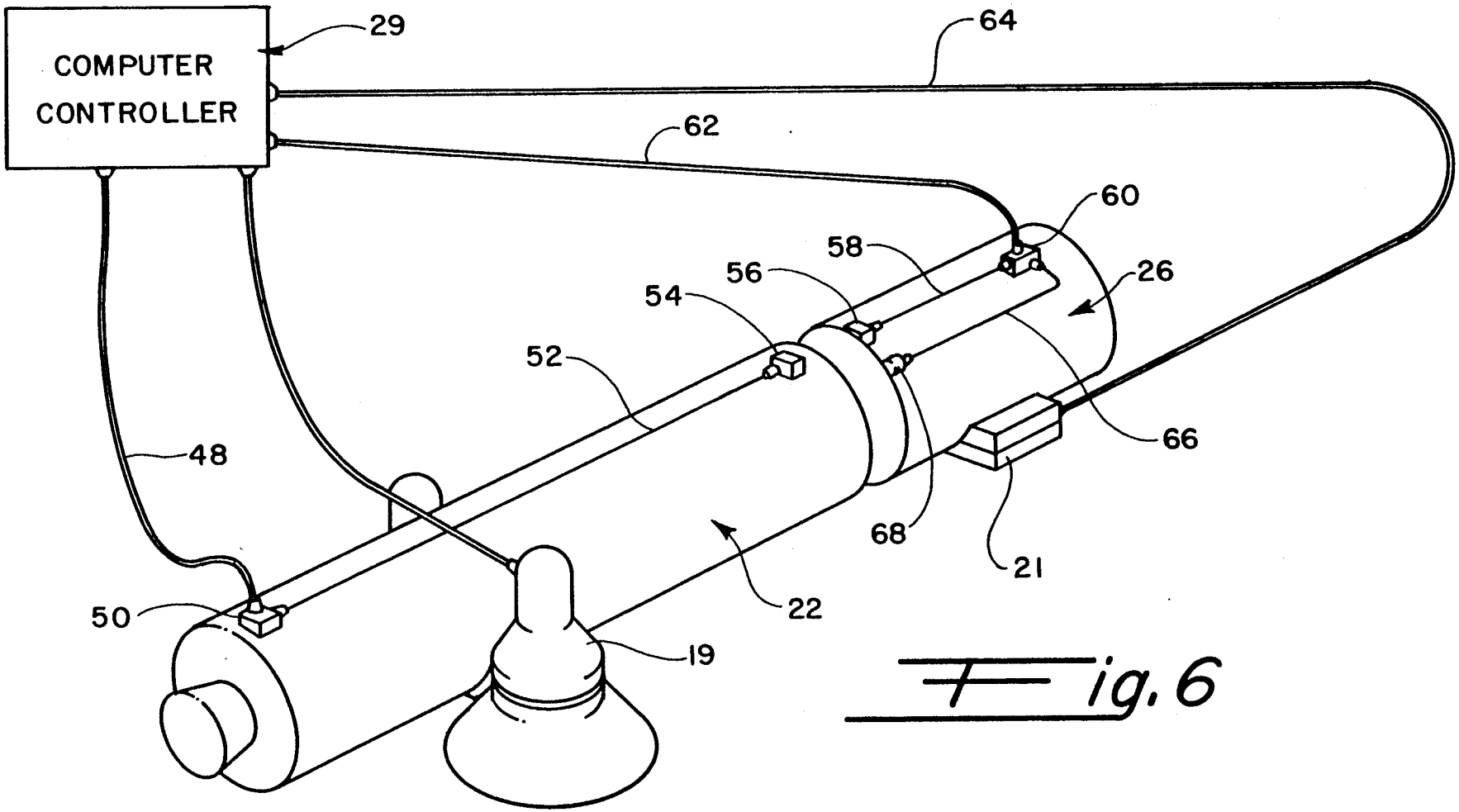
FIG. 6 is a schematic diagram of missile and a warhead with their signal interfaces shown schematically.

As shown in FIG. 6, the computer controller 29 is connected to the missile 22 by means of cable 48. The cable 48 is connected to a missile guidance/control module 50 which in turn is connected through missile cable 52 to a missile signal interface module 54. Placed opposite the missile signal interface module 54 located on the missile 22, is a warhead signal interface module 56 located on the warhead 26. The warhead signal interface module 56 is connected by warhead cable 58 to a warhead processor 60 which in turn is connected by cable 62 to the computer controller 29. Signals conveyed between the missile signal interface module 54 and the warhead signal interface module 56 constitute a connectorless interface between the missile 22 and the warhead 26.

The warhead signal interface module 56 serves as a connectorless interface subassembly for a carried item; and the missile signal interface module 54 serves as a connectorless interface subassembly for a carrying assembly. The two subassemblies, in combination, comprise the connectorless interface for data transfer.

Alternatively, the connectorless interface subassembly for the carried item and the connectorless interface subassembly for the carrying assembly can transfer power across the connectorless interface formed by the combination of the two subassemblies.

A connectorless interface can be implemented by magnetic, optic, or acoustic coupling or by a combination of these methods. It should be noted that in-flight missile and warhead signals and power can be transmitted or received across the connectorless interface from or to the missile guidance/control device from or to the warhead processor after the ground-based computer controller and its cabling has been disconnected from the missile 22 and the warhead 26.

Also connected to warhead processor 60, through cable 66, is a coded V-band drive control module 68 which will not actuate the drive motor 46, drive shaft 44, and V-band 42 to join the warhead 26 to the missile 22 when an incorrect warhead and missile are in alignment. The powered carriage 21 is connected to the computer controller by cable 64. The powered carriage 21 is a simplified implementation of top fixture 30 and bottom fixture 28 shown in FIG. 3 with a vault configuration.

Figure 7:
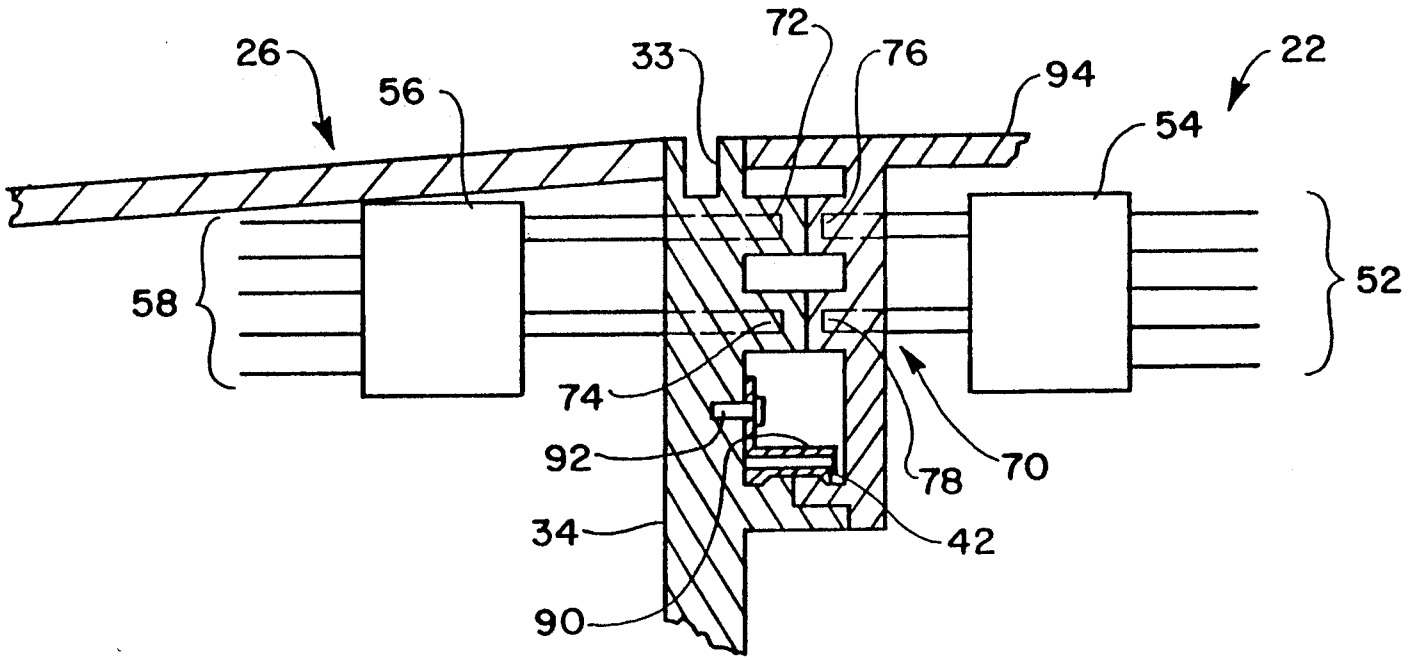
FIG. 7 is a schematic diagram showing a missile and a warhead in proper juxtaposition and joined by a V-band.
Figure 8:
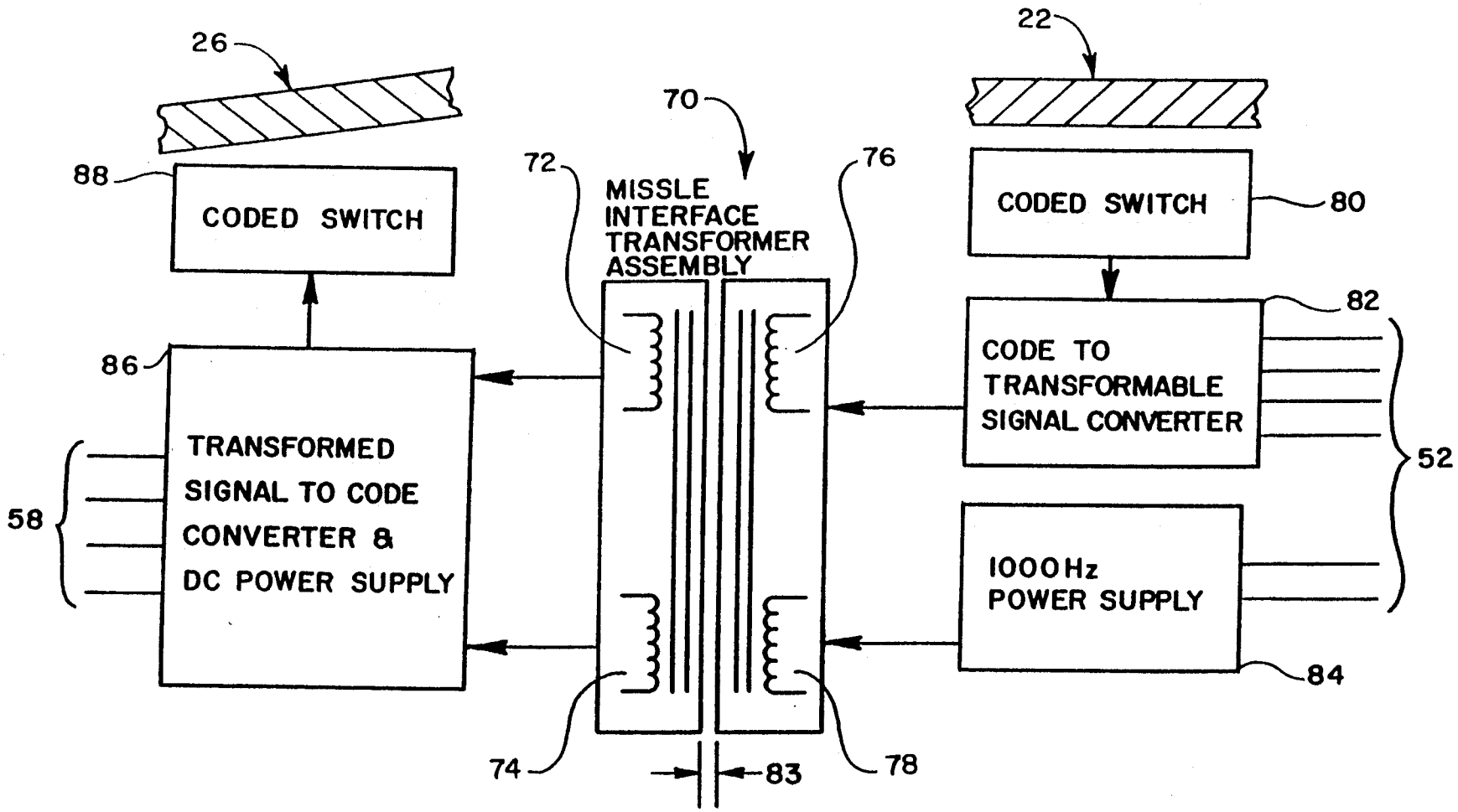
FIG. 8 is a block diagram showing a portion of the electronic circuits employed with one embodiment of the invention.

In FIG. 7, a partially enlarged view is shown of the connectorless interface between the missile signal interface module 54 and the warhead signal interface module 56 shown in FIG. 6. An electrical block diagram of the connectorless interface between the missile 22 and the warhead 26 is shown in FIG. 8. More specifically, an interfacing split transformer assembly 70 is provided which includes coils 72 and 74 associated with the warhead 26 and coils 76 and 78 associated with the missile 22. The coils 72 and 74 associated with the warhead 26 and the coils 76 and 78 associated with the missile 22 are not connected to each other. Instead, there is a connectorless interface between them, respectively. When coils 72 and 74 from the warhead 26 are in proper alignment with and are the proper distance from coils 76 and 78, respectively, of the missile 22, then the missile 22 and the warhead 26 are in proper alignment.

When the missile 22 and the warhead 26 are in proper alignment, the signal flow across the connectorless interface is at its maximum. Both the respective missile signal interface module 54 and the warhead signal interface module 56 are provided with sensing means for detecting the signal flow across the connectorless interface. Servomechanisms (not shown) are provided which respond to these signals and adjust the alignment to obtain a maximum signal indicative of proper alignment.

Further with respect to FIG. 8, a coded switch 80 associated with the missile 22 encodes a signal converter 82 to provide a coded signal at coil 76. A 1000 Hz power supply 84 provides power to the interfacing transformer assembly 70 from the missile 22. Power is conveyed across the connectorless gap 83 to respectively opposing coils 72 and 74 associated with the warhead 26 and then to a transformed signal and code converter and DC power supply module 86 which controls another coded switch 88 on the warhead. If the code from the missile coded switch 80 matches the code at the warhead coded switch 88, then the V-band assembly 40 would be actuated to join the missile and warhead together. However, if the code from the warhead and the code in the missile do not match, then the V-band assembly 40 would not be actuated to join the missile and warhead together. After alignment and assembly of missile 22 to warhead 26, subsequent data and power transfer can take place between missile guidance/control unit 50 and warhead processor 60 via missile cable 52, warhead cable 58, and the connectorless interface.

Further with respect to FIG. 7, the support ring 34, associated with the warhead 26, has a pin-receiving hole 33 and houses coils 72 and 74 of the interfacing split transformer assembly 70. The support ring 34 also includes a retention cowl 90 secured to the support ring 34 by screws 92. A missile attaching ring 94 is provided on the missile 22. The missile attaching ring 94 houses coils 76 and 78 of the interfacing split transformer assembly 70. The missile attaching ring 94 also includes structural components designed to engage complementary structural components on the support ring 34 to join the missile 22 to the warhead 26 when the V-band 42 is contracted.

Figure 10:
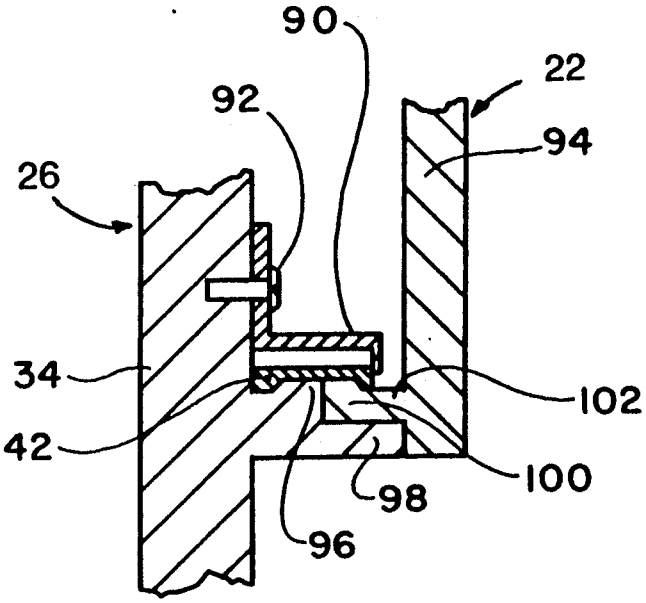
FIG. 10 is a close up view of the embodiment shown in FIG. 9 after attaining proper juxtaposition of the warhead and the missile and after locking the V-band.
Figure 9:
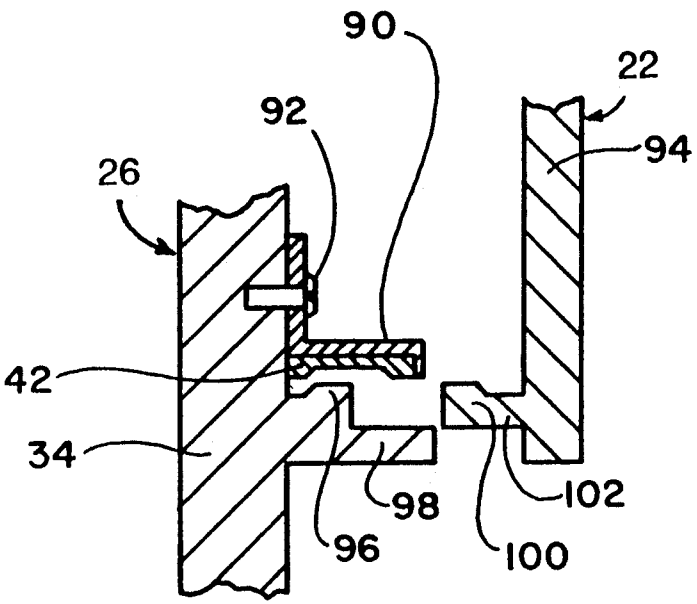
FIG. 9 is a close up view of an embodiment of means for joining a warhead to a missile prior to proper juxtaposition.

FIGS. 9 and 10 are partial enlargements of the respective structures of the warhead and missile that are joined by the V-band assembly 40 when the warhead and missile are properly aligned.

In FIG. 9, the missile 22 and the warhead 26 are not yet in proper alignment. In this respect, a vertical hump portion 96 and a horizontal extension portion 98 of the support ring 34 associated with the warhead 26 are not in contact with complementary structures of the missile attaching ring 94 of the missile 22. Prior to joining the missile and warhead, the V-band 42 is in the expanded position shown in FIG. 9 where the V-band 42 is expanded up against the retention cowl 90.

In FIG. 10, however, the missile 22 and the warhead 26 are in proper alignment. In this respect, the vertical hump portion 96 and the horizontal extension portion 98 of the support ring 34 are in complementary engagement with a complementary vertical hump portion 100 and a complementary horizontal extension portion 102 of the missile attaching ring 94. Along with this complementary engagement of structures from the warhead support ring 34 and the missile attaching ring 94, the V-band 42 is shown in the contracted position in FIG. 10, whereby the V-band 42 securely locks and joins the warhead 26 and missile 22 together.

Programming the computer controller 29 to control the computer-controlled components of the invention is well within the ordinary skill of a person versed in the principles of computer control. Furthemore, interfacing the computer-controlled components with the computer controller 29 is also well within the ordinary skill of a person versed in the principles of computer interfacing. The computer controller 29 is equipment located on the ground, and upon launch, the missile is disconnected from that equipment. Then, power and data signals are transmitted or received within the missile assemblage solely by means of the connectorless interface.

Numerous modifications and variations can be made to the embodiments illustrated in the drawings. For example, each vault can have two openings or doors which are remotely commanded by the use of coded locks. One door is a side door that permits translation of a warhead or reentry vehicle for juxtaposition next to a weapon carrier and coupling thereto. The second door is a top door that permits a coupled warhead or reentry vehicle/weapon carrier to be raised out of the vault to the firing position. By having the vaults controlled by coded locks, nuclear safety is assured. System operation would be designed to preclude crews having access to the codes until they are authorized by competent authority.

As stated above, the V-band assembly 40 includes a drive mechanism and a V-band. The drive mechanism can reduce the band diameter and secure the warhead or reentry vehicle to the weapon carrier during assembly or can increase the band diameter to permit the warhead or reentry vehicle and weapon carrier to be disassembled. The drive mechanism can include a motor driven worm screw drive mechanism that is remotely controlled.

In summary, numerous benefits have been described which result from employing the principles of the invention. With the invention, apparatus is provided for remote control of assembly and disassembly of major missile components. With the invention, apparatus is provided for assembly and disassembly of major missile components in which data and control signals are transmitted across an interface between major missile sections while the missile is on the ground and after it is in flight. In accordance with the principles of the invention, apparatus is provided for assembly and disassembly of major missile components in which repetitive assembly and disassembly of major missile components are carried out automatically, instead of manually requiring specially trained personnel and special tools. With the invention, automatic apparatus is provided for assembly and disassembly of major missile components that provides a strong connection that withstands static and dynamic forces encountered on the ground and in flight.

With the automated system of the invention, the system can be a closed system, and personnel would not have to enter the closed system in order to carry out assembly operations. Operation of such a closed system would be easier to maintain in secrecy than a system requiring entry of personnel to carry out operations.

The foregoing description of the invention has been presented for purposes of illustration and description. It is not intended to be exhaustive or to limit the invention to the precise form disclosed. Obvious modifications or variations are possible in light of the above teachings.

For example, the principles of the invention can be employed with respect to removal and replacement of warheads or reentry vehicles on manned aircraft as well as unmanned weapons carriers. For instance, the removal of a nuclear weapon and its replacement with a conventional, chemical, or special warhead or reentry vehicle can be carried out. A particular application of this concept is that associated with nuclear arming of Allied aircraft. Once armed, such aircraft become very limited in movement, and this limitation may impact upon the flexibility of dispersal options. If such aircraft were provided with missiles having quick attachable warhead capability, they could disperse with conventional warheads and be quickly retrofitted with nuclear weapons when needed.

Although a V-band assembly is disclosed for coupling a selected warhead or reentry vehicle to a selected weapon carrier, other coupling means can be employed which include interlocking mechanical fingers or a motor-driven cam and lock system.

More specifically with respect to finger joints, the finger joints can protrude from the aft or rear section. Between each finger is a space of the same width. The fingers slide into a complementary spline-like device on the unit to which the warhead or reentry vehicle is mounted. The tips of the respective fingers would be designed with a protruding section that would fit into a detent on the splined portion of the unit to which the warhead or reentry vehicle is being mounted. The protrusions on the fingers would absorb the axial loads, while the fingers within the splines would absorb the radial or transverse loads. A lock ring would fit over the fingers and spline to both keep the assembly together and to help absorb loads transmitted through the fingers. The lock ring would be held in this position with, for example, rods. The rods are driven to translate the lock ring to a position either over the fingers for assembly or off the finger area for disassembly. Disassembly would be effected by an eject ring, which is of a diameter small enough to pass through the lock ring. The eject ring, also translated by rods that are driven, would move to the end of the fingers (the lock ring having previously moved away) and force them outward (up from their detent position) so that the warhead or reentry vehicle or weapon carrier can be moved off the splined assembly to effect its removal.

The particular coupling means selected for a given application would depend upon size, weight, and power constraints among other considerations.

As stated above, the principles of the invention can be used generally to assemble an item to-be-carried to a carrying assembly. More specifically, in this regard, means are provided for conveying alignment information between the item to-be-carried and the carrying assembly, wherein the item to-be-carried and the carrying assembly are not connected to one another, the alignment information being in the form of signals transmitted and received between the item to-be-carried and the carrying assembly. Although the item to-be-carried has been disclosed as being a warhead or reentry vehicle, and the carrying assembly has been disclosed as being a missile, the principles of the invention can be used for other items to-be-carried and for other carrying assemblies. For example, the principles of the invention, can be used for aligning and assembling the following items to-be-carried onto missiles: guidance system packages, test units, decoy packages, chaff packages, and any other item to-be-carried that could conceivably be attached to a carrying assembly (both self launching and those associated with aircraft e.g. air-to-ground). Likewise, the principles of the invention are equally applicable where the weapon carrier is a bomb.

With an air-to-ground tactical missile, both nuclear and conventional capability could be incorporated in the missile design. The capability to quickly change from a conventional to a nuclear warhead, or vice versa, on missiles associated with dual capable aircraft in the European theater, as an example, would provide greater flexibility of operations to both U.S. and Allied dual capable aircraft. A cart containing the appropriate warhead and support translation mechanism would be a quick way to approach an aircraft on a ramp, or in a hide, to be able to switch, or remove, or emplace a warhead. A dual capable aircraft could be flown from one point to another with a missile without a warhead (e.g. flight with an aerodynamic shape cover), but which would be subsequently loaded from the cart.

A ground or ship launched missile system, where the missile is loaded with a warhead, which is selected from a magazine appropriate to the mission can be employed with the invention. That is, a magazine could consist of nuclear, chemical, or conventional warheads to be fitted to a standard missile as needs dictate. Safety of operations could be assured by providing specific index stations on the missile so that a particular type warhead is capable of interface to only its particular nonelectrical interface index position. Further refinement could consist of a dissimilar data scheme so that data provide for control of a conventional warhead is incompatible with a nuclear warhead.

By following the principles of the invention, rapid removal of a warhead for test purposes can be effected. This can be done for testing either the warhead alone of the missile alone. In this case also, a missile test warhead could be rapidly emplaced by the same mechanism that attaches the operational warheads.

In accordance with principles of the invention for assembling one item to another item using information signals between the items without having the items in actual contact with one another until final appropriate juxtaposition, applications involving the space program can be obtained. Pipes and conduits can be remotely attached, especially those that are difficult to reach manually because of their inconvenient location and those that are in toxic environments.

By following the principles of the invention, large or heavy objects can be installed on pipes, conduits, tubes, and so forth. Such objects can include test devices and inspection covers.

By employing the principles of the invention, lenses and sensing devices mounted on and perhaps frequently changed on airborne surveillance and detection platforms can be remotely changed. Such pods that are attached to helicopters and aircraft can be changed by following the principles of the invention.

The principles of the invention can be used to assemble certain parts of a space station. Cylindrical or certain other shape column, rod, or tube structures could be assembled quickly by astronauts or from remote command centers by following the principles of the invention. The rapid assembly and disassembly features of the invention can be used for reconfiguration of a space platform.

The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. An apparatus for assembling selected warheads or reentry vehicles with selected weapon carriers, comprising:

a first storage area containing a plurality of warheads or reentry vehicles, a second storage area containing a plurality of weapon carriers, means for selecting a warhead or reentry vehicle from said first storage area, means for selecting a weapon carrier from said second storage area, means for transporting said selected warhead or reentry vehicle to said selected weapon carrier, automatic means for coupling said selected warhead or reentry vehicle to said selected weapon carrier.

2. The apparatus described in claim 1 wherein said apparatus is used for both assembling said selected warhead or reentry vehicle with and disassembling said selected warhead or reentry vehicle from said selected weapon carrier.

3. The apparatus described in claim 1 wherein said weapon carrier is a missile.

4. The apparatus described in claim 1 wherein said weapon carrier is a bomb.

5. The apparatus described in claim 1 wherein said first storage area includes fixtures for retaining said plurality of warheads or reentry vehicles in a specified orientation.

6. The apparatus described in claim 5 wherein said fixtures include a plurality of retractable hold pins which fit into complementary pin-receiving holes in respective integrated support rings which support said warheads or reentry vehicles in the specified orientation.

7. The apparatus described in claim 1 wherein said first storage area includes a plurality of vaults, each vault including a side door, which, when open, permits entry of a weapon carrier for coupling to a warhead or reentry vehicle, and each vault including a top door permitting a coupled warhead or reentry vehicle and weapon carrier to be elevated into a firing position.

8. The apparatus described in claim 1 wherein said second storage area includes fixtures for retaining said plurality of weapon carriers in a specified orientation.

9. The apparatus described in claim 1 wherein said coupling means includes a V-band coupling assembly.

10. The apparatus described in claim 1 wherein said coupling means includes a V-band coupling assembly which includes an expandable and contractible V-band, a motor coupled to said V-band for expanding and contracting said V-band when complementarily engaging structures of an adjacent warhead or reentry vehicle and weapon carrier are juxtaposed.

11. The apparatus described in claim 1 wherein said automatic coupling means includes a connectorless interface between said selected warhead or reentry vehicle and said selected weapon carrier, said connectorless interface for conveying orientation information between said selected warhead or reentry vehicle and said selected weapon carrier.

12. The apparatus described in claim 11 wherein said connectorless interface conveys orientation information by means of magnets and magnet detectors.

13. The apparatus described in claim 11 wherein said connectorless interface conveys orientation information by means of light transmitters and light receivers.

14. The apparatus described in claim 13 wherein a light transmitter can be a light emitting or laser diode.

15. The apparatus described in claim 11 wherein said connectorless interface conveys orientation information by means of electrical transformers.

16. The apparatus described in claim 11 wherein said connectorless interface conveys orientation information by means of acoustic transmitters and receivers.

17. The apparatus described in claim I wherein said automatic coupling means includes a connectorless interface between said selected warhead or reentry vehicle and said selected weapon carrier, wherein said connectorless interface transfers power and signals between a warhead or reentry vehicle and an attached missile while on the ground or while in flight.

18. The apparatus described in claim 1 wherein said automatic coupling means includes a plurality of connectorless interfaces between a plurality of types of said selected warheads or reentry vehicles and a plurality of types of said selected weapon carriers, such that if a particular warhead or reentry vehicle is indexed with an incompatible weapon carrier, the incompatible warhead or reentry vehicle and weapon carrier will not be coupled.

19. An apparatus for assembling selected warheads or reentry vehicles with selected weapon carriers, comprising:

a first storage area containing a plurality of warheads or reentry vehicles, a second storage area containing a plurality of weapon carriers, computer-controlled means for selecting a warhead or reentry vehicle from said first storage area, computer-controlled means for selecting a weapon carrier from said second storage area, computer-controlled means for transporting said selected warhead or reentry vehicle to said selected weapon carrier, and automatic computer-controlled means for coupling said selected warhead or reentry vehicle to said selected weapon carrier, wherein said automatic coupling means include a connectorless interface between said selected warhead or reentry vehicle and said selected weapon carrier, said connectorless interface for conveying orientation information between said selected warhead or reentry vehicle and said selected weapon carrier, for determining when an adjacent warhead or reentry vehicle and weapon carrier are juxtaposed, and wherein said automatic coupling means includes a V-band coupling assembly which includes an expandable and contractible V-band for joining complementary engaging structures of said selected warhead or reentry vehicle and said selected weapon carrier, a motor coupled to said V-band for expanding and contracting said V-band when the adjacent warhead or reentry vehicle and weapon carrier are juxtaposed.

20. An apparatus for assembling an item to-be-carried with a carrying assembly, comprising:

means for conveying alignment information between the item to-be-carried and the carrying assembly, wherein the item to-be-carried and the carrying assembly are not connected to one another, said alignment information being in the form of signals conveyed between the item to-be-carried and the carrying assembly, means, responsive to said alignment information, for orienting the item to-be-carried with respect to the carrying assembly, and means, responsive to said alignment information, for connecting the item to-be-carried to the carrying assembly when the item to-be-carried and the carrying assembly are appropriately juxtaposed.

21. An apparatus for joining a warhead or reentry vehicle to a weapon carrier, comprising:

a V-band coupling assembly which includes an expandable and contractible V-band, a retention cowl for retaining said V-band in an expanded state, and a motor coupled to said V-band for expanding and contracting said V-band, engaging structures of the warhead or reentry vehicle for engaging an adjacent weapon carrier, engaging structures of the weapon carrier for engaging an adjacent warhead or reentry vehicle, said engaging structures of the warhead or reentry vehicle and the weapon carrier being complementary, said engaging structures of the warhead or reentry vehicle and of the weapon carrier being complementary to each other and being complementary to the V-band, such that when the warhead or reentry vehicle and the weapon carrier are in proper alignment, and when said V-band is contracted, the warhead or reentry vehicle, the weapon carrier, and the V-band form a mutually complementary joint for joining the warhead or reentry vehicle with the weapon carrier.

22. An apparatus for assembling a first item with a second item, comprising:

means for conveying alignment information between the first item and the second item, wherein the first item and the second item are not connected to one another, said alignment information being in the form of signals conveyed between the first and second items, means, responsive to said alignment information, for orienting the first item with respect to the second item, and means, responsive to said alignment information, for connecting the first item to the second item when the first item and the second item are appropriately juxtaposed.

23. A method for assembling selected warheads or reentry vehicles with selected weapon carriers, comprising the steps of:

remotely selecting a weapon carrier from a plurality of weapon carriers, remotely selecting a warhead or reentry vehicle from a plurality of warheads or reentry vehicles, automatically aligning the selected warhead or reentry vehicle with the selected weapon carrier, and automatically coupling the aligned selected warhead or reentry vehicle to the selected weapon carrier.

24. The method described in claim 23 wherein the selected warhead or reentry vehicle is aligned with the selected weapon carrier by means of a connectorless interface across which alignment information is conveyed between the selected warhead or reentry vehicle and the selected weapon carrier.

25. A method for assembling a selected warhead or reentry vehicle with a selected weapon carrier, comprising the steps of:

automatically aligning the selected warhead or reentry vehicle with the selected weapon carrier by means of a connectorless interface across which alignment information is conveyed between the selected warhead or reentry vehicle and the selected weapon carrier, and automatically coupling the selected warhead or reentry vehicle to the selected weapon carrier when they are properly aligned.

26. An apparatus for transferring power or data across a connectorless interface between a carried item and a carrying assembly, comprising:

a connectorless interface subassembly on the carried item, a computer processor and cabling on the carried item connected to said carried item connectorless interface subassembly, a connectorless interface subassembly on the carrying assembly, and a computer processor and cabling on the carrying assembly connected to said carrying assembly connectorless interface subassembly, wherein said carried item connectorless interface subassembly and said carrying assembly connectorless interface subassembly constitute the connectorless interface.

* * * * *